US006132947A

United States Patent [19]

Honan et al.

[11] Patent Number: 6,132,947

[45] Date of Patent: Oct. 17, 2000

[54] CYAN COUPLER, AND STABILIZER-CONTAINING PHOTOGRAPHIC ELEMENT AND PROCESS

[75] Inventors: James S. Honan, Spencerport, N.Y.; Rakesh Jain, Cupertino, Calif.; John W. Harder, Rochester; William J. Begley, Webster, both of N.Y.

[73] Assignee: Eastman Kodak Company, Rochester, N.Y.

[21] Appl. No.: 09/266,233

[22] Filed: Mar. 10, 1999

[51] Int. Cl.[7] ..... G03C 1/73

[52] U.S. Cl. ..... 430/546; 430/552; 430/553; 430/613

[58] Field of Search ..... 470/546, 552, 470/553, 613

[56] References Cited

U.S. PATENT DOCUMENTS

| | | | |
|---|---|---|---|
| 4,865,957 | 9/1989 | Sakai et al. | 430/505 |
| 5,004,675 | 4/1991 | Yoneyama et al. | 430/377 |
| 5,047,314 | 9/1991 | Sakai et al. | 430/505 |
| 5,047,315 | 9/1991 | Morigaki et al. | 430/544 |
| 5,057,408 | 10/1991 | Takahashi et al. | 430/546 |
| 5,120,636 | 6/1992 | Takahashi et al. | 430/546 |
| 5,162,197 | 11/1992 | Aoki et al. | 430/546 |
| 5,378,596 | 1/1995 | Naruse et al. | 430/549 |
| 5,686,235 | 11/1997 | Lau et al. | 430/553 |

OTHER PUBLICATIONS

Solvents on pp. 137–144 in Japanese application 62–215/272, Sep. 1987.

*Primary Examiner*—Hoa Van Le

*Attorney, Agent, or Firm*—Arthur E. Kluegel

[57] ABSTRACT

Disclosed is a photographic element comprising at least one light sensitive silver halide emulsion layer having associated therewith:

(A) a phenolic cyan dye-forming "NB coupler";

(B) a high boiling solvent having Formula (II):

$$R^3OO—C—(—G—)—C—OO—R^4 \quad \text{(II)}$$

wherein:

$R^3$ and $R^4$ represent independently selected alkyl or aryl groups; and

G represents an alkyl (including cycloalkyl and aralkyl) containing linking group; and (C) a stabilizer having Formula (III):

(III)

wherein each Y is an independently selected substituent and m is 0 to 4; and each T is an independently selected substituent and p is 0 to 4.

49 Claims, No Drawings

CYAN COUPLER, AND STABILIZER-CONTAINING PHOTOGRAPHIC ELEMENT AND PROCESS

FIELD OF THE INVENTION

The present invention relates to a color photographic element containing a particular type of phenolic cyan coupler in combination with a described solvent and stabilizer.

BACKGROUND OF THE INVENTION

In silver halide based color photography, a typical photographic element contains multiple layers of light-sensitive photographic silver halide emulsions coated on a support with one or more of these layers being spectrally sensitized to each of blue light, green light and red light. The blue, green, and red light-sensitive layers typically contain yellow, magenta, and cyan dye-forming couplers, respectively. After exposure to light, color development is accomplished by immersing the exposed material in an aqueous alkali solution containing an aromatic primary amine color-developing agent. The dye-forming couplers are selected so as to react with the oxidized color developing agent to provide yellow, magenta and cyan dyes in the so called subtractive color process to reproduce their complementary colors, blue, green and red as in the original image.

The important features for selecting the dye-forming coupler include, efficient reaction with oxidized color developing agent, thus minimizing the necessary amounts of coupler and silver halide in the photographic element; the formation of dyes with hues appropriate for the photographic use of interest, for color photographic paper applications this requires that dyes have low unwanted side absorption leading to good color reproduction in the photographic print; minimization of image dye loss contributing to improved image permanence under both ambient illumination and conventional storage conditions; and in addition the selected dye-forming coupler must exhibit good solubility in coupler solvents, provide good dispersibility in gelatin and remain stable during handling and manipulation for maximum efficiency in manufacturing processes.

In recent years, a great deal of study has been conducted to improve dye-forming couplers for silver halide photosensitive materials in terms of improved color reproducibility and image dye stability. However, further improvements are needed, particularly in the area of cyan couplers. In general, cyan dyes are formed from naphthols and phenols as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479,043; and in British patent 2,070,000. These types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in color photographic film and paper products, the dyes derived from them still suffer from poor stability to heat, humidity or light, low coupling efficiency or optical density, and in particular from undesirable blue and green absorptions which cause considerable reduction in color reproduction and color saturation.

Cyan couplers which have been recently proposed to overcome some of these problems are 2,5-diacylaminophenols containing a sulfone, sulfonamido or sulfate moiety in the ballasts at the 5-position, as disclosed in U.S. Pat. Nos. 4,609,619, 4,775,616, 4,849,328, 5,008,180, 5,045,442, and 5,183,729; and Japanese patent applications JP02035450 A2, JP01253742 A2, JP04163448 A2, JP04212152 A2, and JP05204110 A2. Even though cyan image dyes formed from these couplers show improved stability to heat and humidity, enhanced optical density and resistance to reduction by ferrous ions in the bleach bath, the dye absorption maxima (λmax) are too bathochromically shifted (that is, shifted to the red end of the visible spectrum) and the absorption spectra are too broad with considerable amounts of undesirable blue and green absorptions. Thus, these couplers are not practical for use in color papers.

The hue of a dye is a function of both the shape and the position of its spectral absorption band. Traditionally, the cyan dyes used in color photographic papers have had nearly symmetrical absorption bands centered in the region of 620 to 680 nm, preferably 630 to 660 nm, and more preferably 635 to 655 nm. Such dyes have rather large amounts of unwanted absorption in the green and blue regions of the spectrum.

More desirable would be a dye whose absorption band is asymmetrical in nature and biased towards the green region, that is, with a steep slope on the short wavelength side. Such a dye would suitably peak at a shorter wavelength than a dye with symmetrical absorption band, but the exact position of the desired peak depends on several factors including the degree of asymmetry and the shapes and positions of the absorption bands of the magenta and yellow dyes with which it is associated.

Recently, Lau et. al., in U.S. Pat. No. 5,686,235 describe a particular class of cyan dye-forming coupler that has been shown to improve thermal stability and hue, particularly, with decreased absorption in side bands and an absorption band that is asymmetrical in nature. However, it has been found that dispersions of these couplers are difficult to prepare free of crystalline material, and are not stable with time in cold storage. Other related patents are U.S. Pat. Nos. 5,047,314, 5,047,315, 5,057,408, and 5,162,197.

Large-scale manufacturing of photographic materials can be severely hindered when crystalline material is present in dispersions and coating melts of such dispersions. This can lead to difficulty in manufacturing by plugging filters and causing defects in coatings of photographic materials. It is therefore desirable to use dispersions which have few, if any, crystals and are stable in cold storage from the time of preparation until the time of use.

The problem to be solved is to provide an element containing a dispersion of the coupler useful in this invention, which dispersion has a low number of crystals, is stable toward crystal formation during manufacturing, and which provides high reactivity for formation dye with oxidized color developing agent.

SUMMARY OF THE INVENTION

The invention provides a photographic element comprising at least one light sensitive silver halide emulsion layer having associated therewith:

(A) a phenolic cyan dye-forming "NB coupler";

(B) a high boiling solvent having Formula (II):

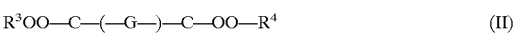

$$R^3OO—C—(—G—)—C—OO—R^4 \quad (II)$$

wherein:

$R^3$ and $R^4$ represent independently selected alkyl or aryl groups; and

G represents an alkyl (including cycloalkyl and aralkyl) containing linking group; and a stabilizer having Formula (III):

(III)

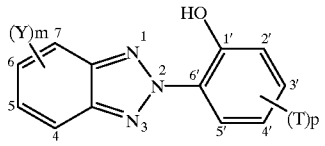

wherein each Y is an independently selected substituent and m is 0 to 4; and each T is an independently selected substituent and p is 0 to 4.

The invention provides an element containing a dispersion of the coupler useful in this invention, which dispersion has a low number of crystals, is stable toward crystal formation during manufacturing, and which provides high reactivity for formation dye with oxidized color developing agent.

DETAILED DESCRIPTION OF THE INVENTION

The invention relates to a photographic element containing a cyan dye-forming coupler which upon processing in the conventional manner forms in the exposed areas, a cyan dye whose absorption spectrum is hypsochromically shifted (that is, shifted toward the blue end of the spectrum) and sharp-cutting on its short wavelength side. The former is particularly necessary for prints obtained in accordance with conventional printing processes, and the latter improves color reproduction and provides high color saturation. In accordance with the invention, these cyan couplers are advantageously combined with certain solvents and stabilizers which enable minimization of the amounts of coupler and silver necessary to achieve good photographic images, low unwanted side-band absorption particularly on the hypsochromic side of the absorption band, improved light stability which can be adjusted to achieve neutral fade with respect to the magenta and yellow dyes, good thermal stability for album keeping, as well as ease in manufacturing defect free coatings because coating filters are not clogged by crystalline materials in the dispersion.

For purposes of this invention, an "NB coupler" is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment the cyan dye-forming "NB coupler" useful in the invention has the formula (IA)

(IA)

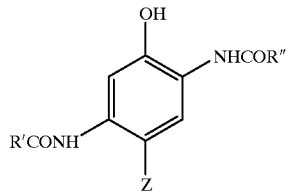

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment the "NB coupler" has the formula (I):

(I)

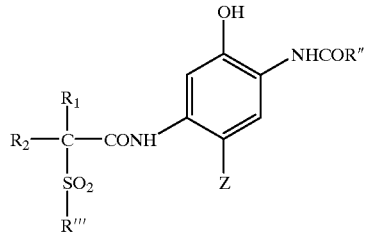

wherein

R" and ‴ are independently selected from unsubstituted or substituted alkyl, aryl, amino, alkoxy and heterocyclyl groups and Z is as hereinbefore defined;

$R_1$ and $R_2$ are independently hydrogen or an unsubstituted or substituted alkyl group; and Typically, R" is an alkyl, amino or aryl group, suitably a phenyl group. R‴ is desirably an alkyl or aryl group or a 5–10 membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone (—$SO_2$—) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl having 3–8 carbon atoms and the term 'aryl' includes specifically fused aryl.

In formula (I), R" is suitably an unsubstituted or substituted amino, alkyl or aryl group or a 5–10 membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-dichlorophenyl, 3,4-difluorophenyl, 4-cyanophenyl, 3-chloro-4-cyanophenyl, pentafluorophenyl, or a 3- or 4-sulfonamidophenyl group.

In formula (I), when R'" is alkyl it may be unsubstituted or substituted with a substituent such as halogen or alkoxy. When R'" is aryl or a heterocycle, it may be substituted. Desirably it is not substituted in the position alpha to the sulfonyl group.

In formula (I), when R'" is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxycarbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA) Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

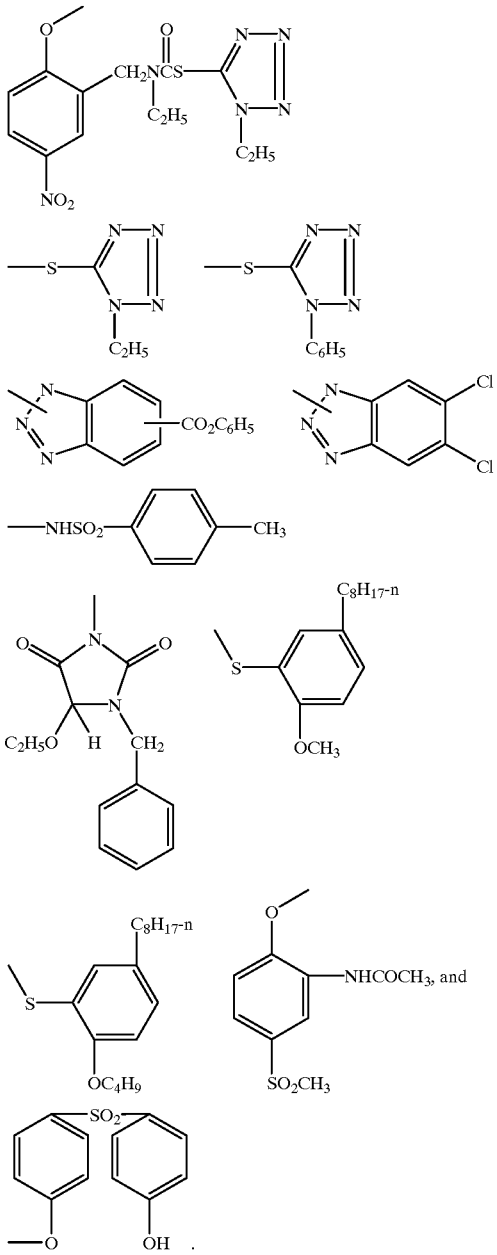

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group Z contains a ballast it is often necessary to ballast the other substituents as well, since Z is eliminated from the molecule upon coupling; thus, the ballast is most advantageously provided as part of groups other than Z.

The following examples further illustrate the invention. It is not to be construed that the present invention is limited to these examples.

IC-1

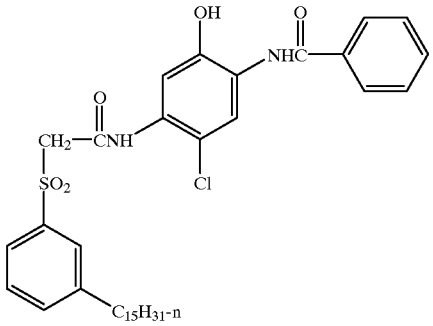

IC-2

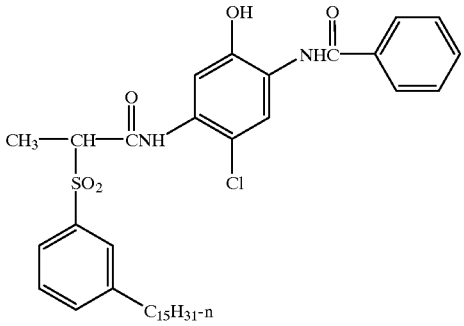

IC-3

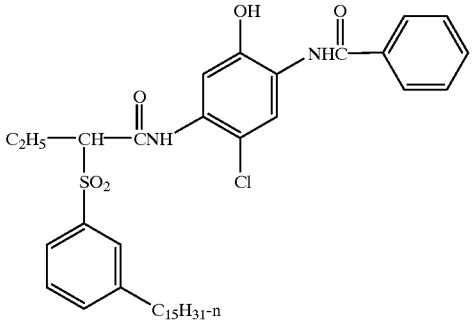

IC-4

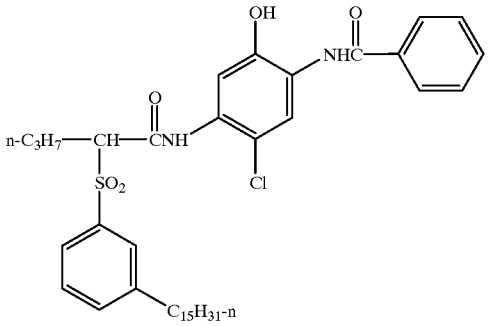

-continued
IC-5
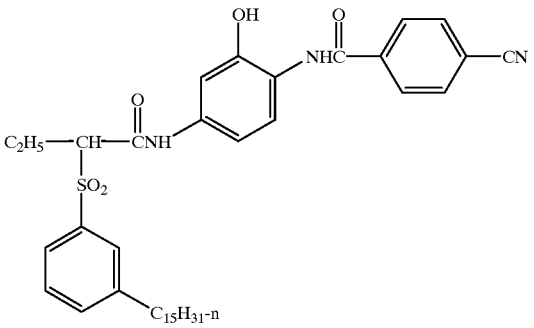
IC-6
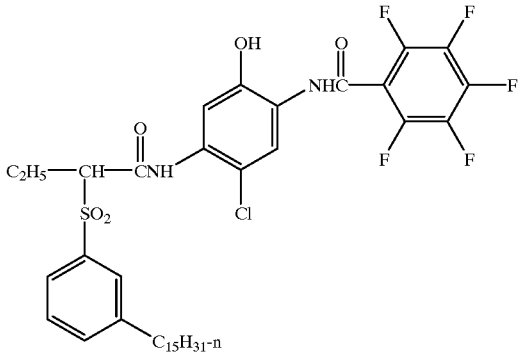
IC-7
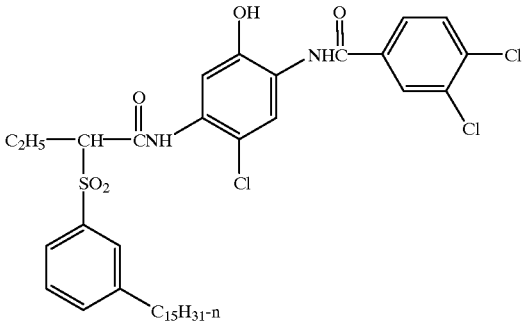
IC-8
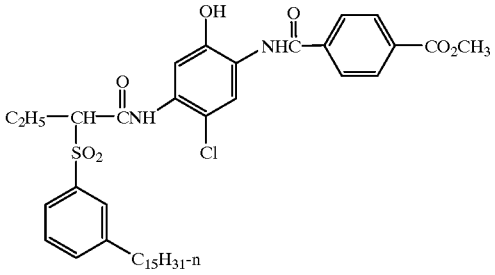
IC-9
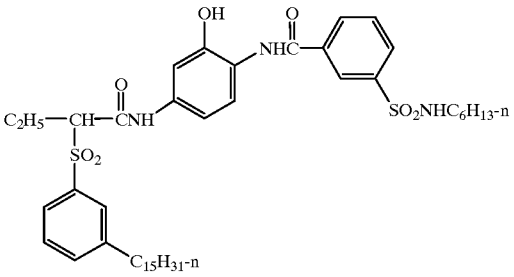
-continued
IC-10
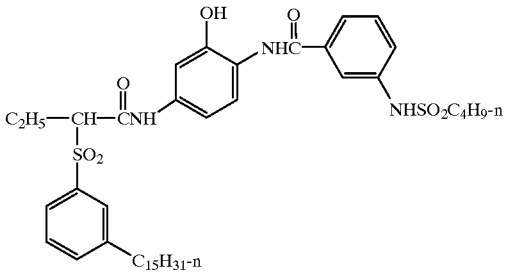
IC-11
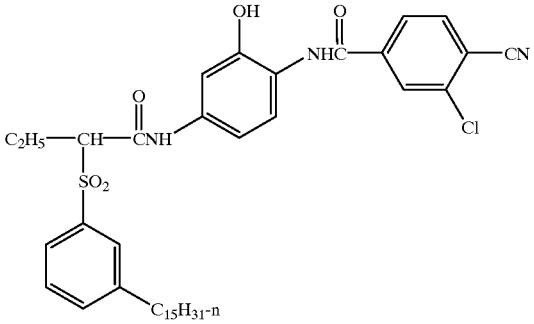
IC-12
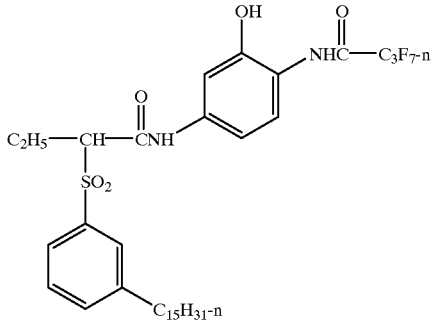
IC-13
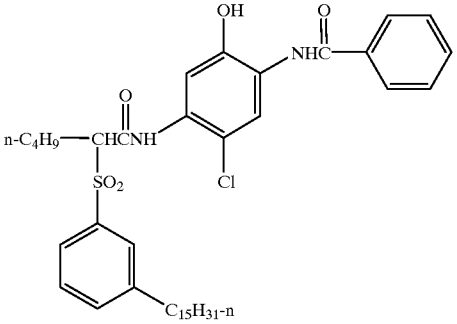
IC-14
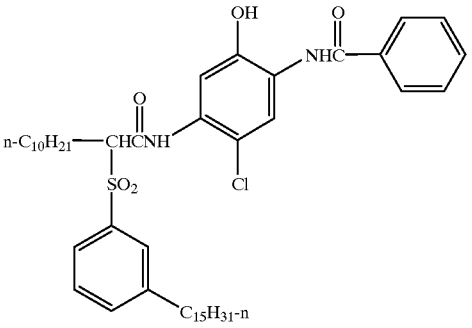

-continued
IC-15
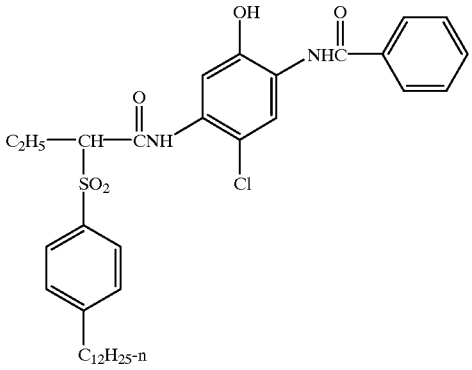
IC-16
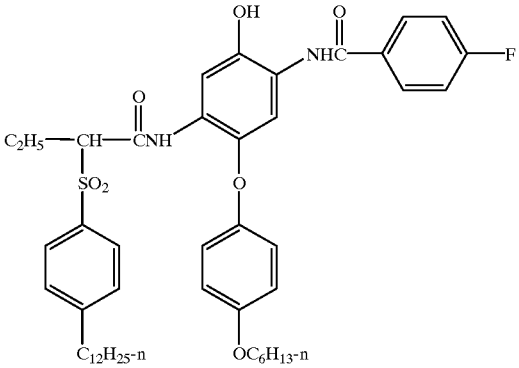
IC-17
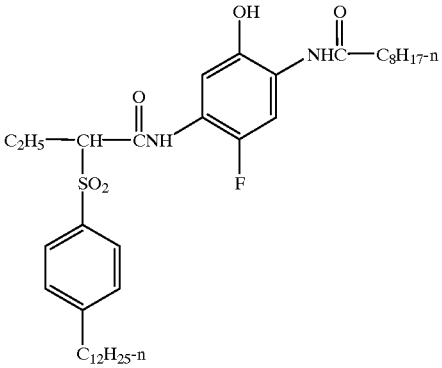
IC-18
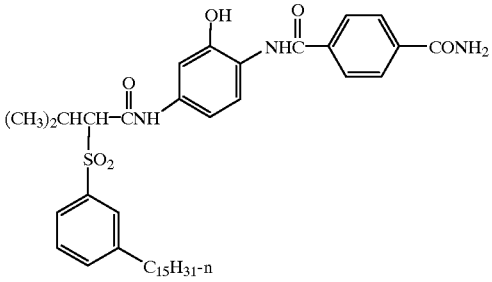
-continued
IC-19
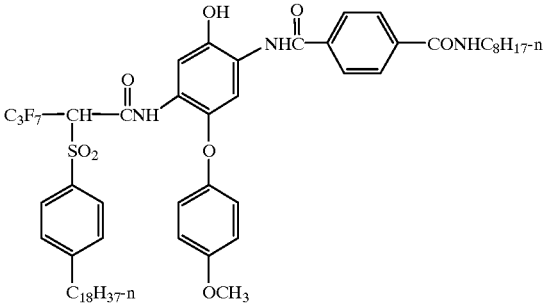
IC-20
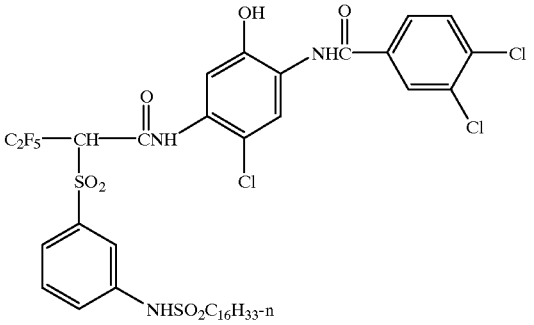
IC-21
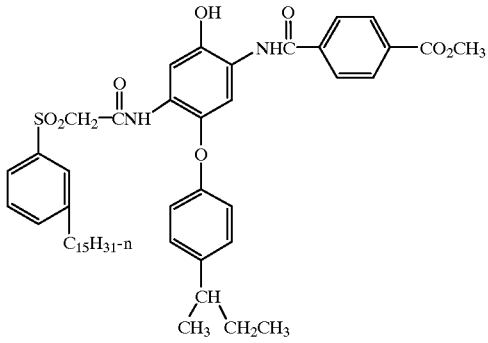
IC-22
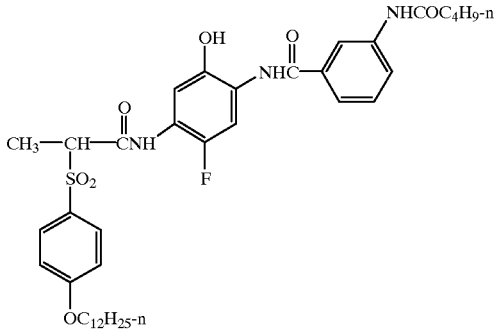

-continued
IC-23
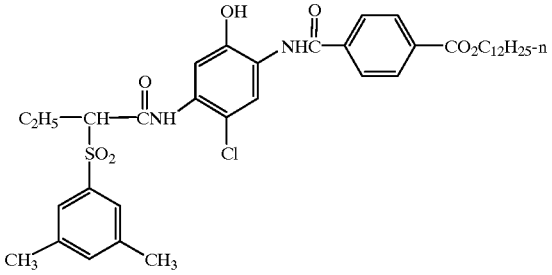
IC-24
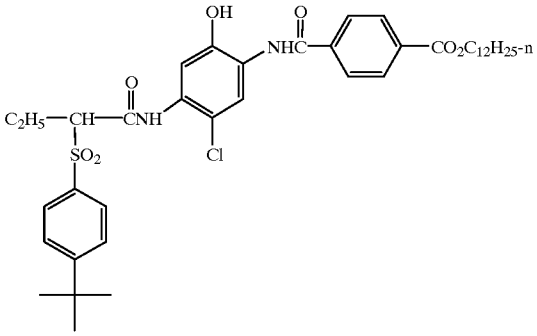
IC-25
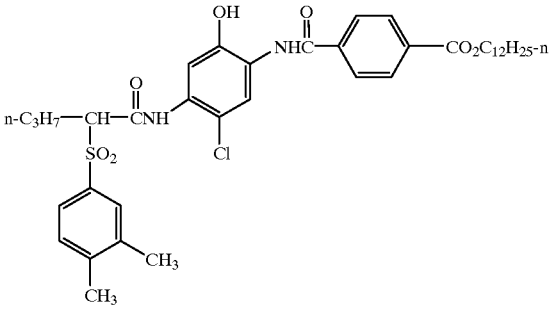
IC-26
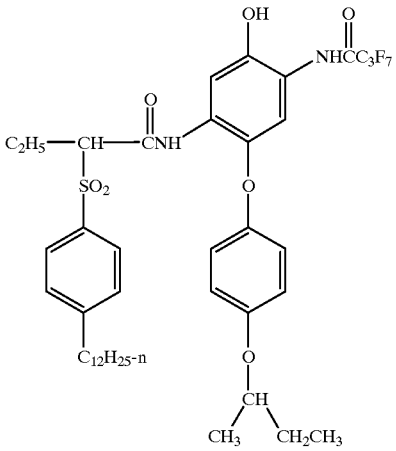
-continued
IC-27
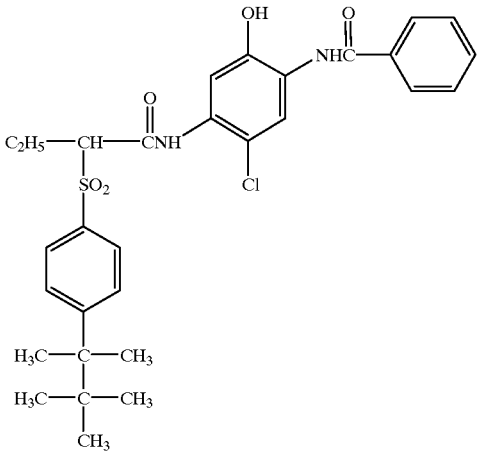
IC-28
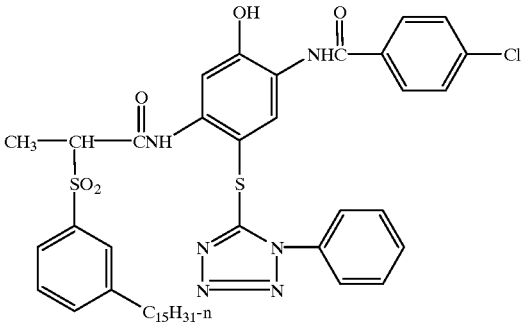
IC-29
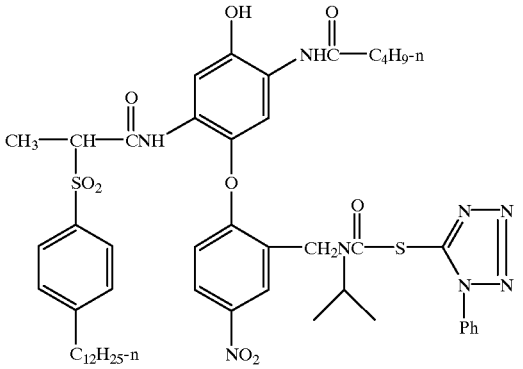
IC-30
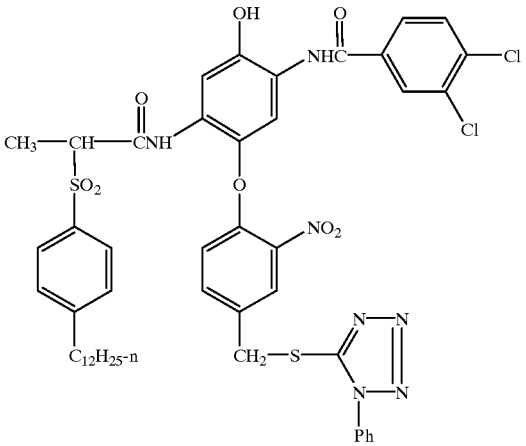

-continued
IC-31
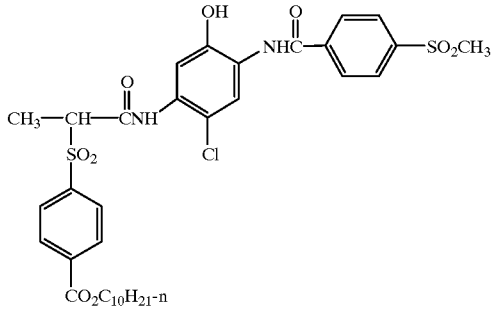
IC-32
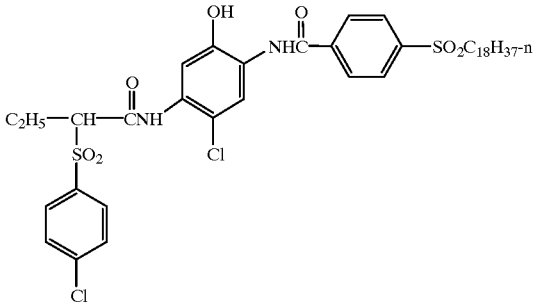
IC-33
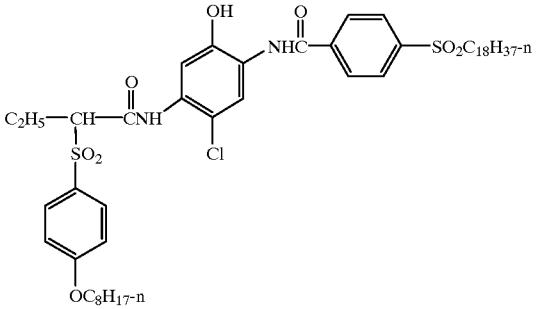
IC-34
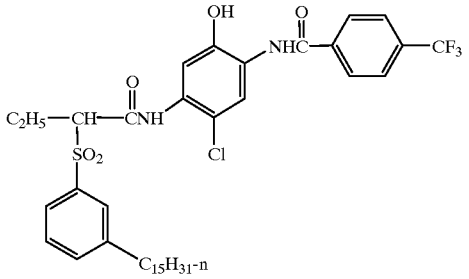
-continued
IC-35
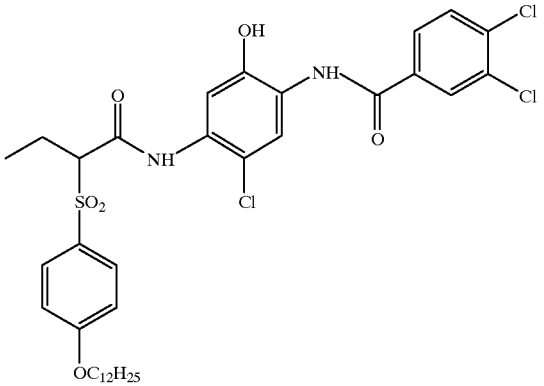
IC-36
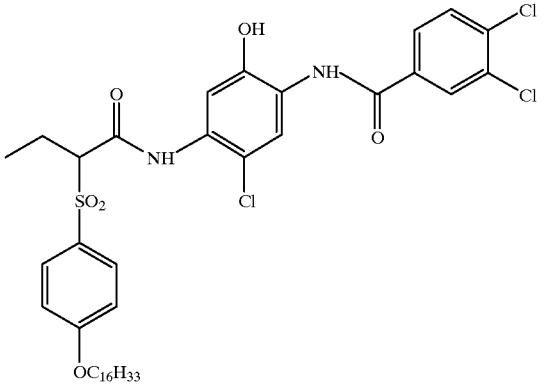
IC-37
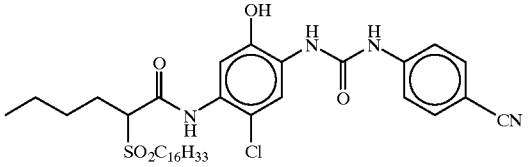
IC-38
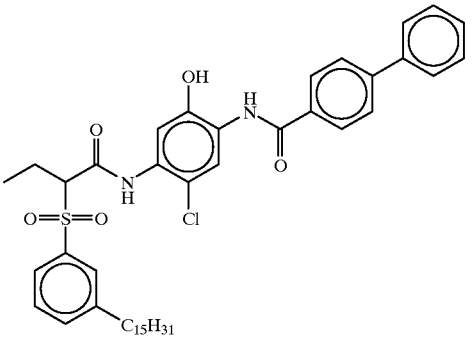
IC-39
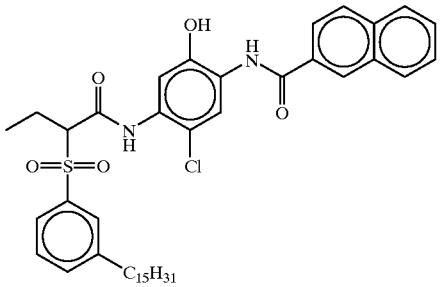

-continued

IC-40

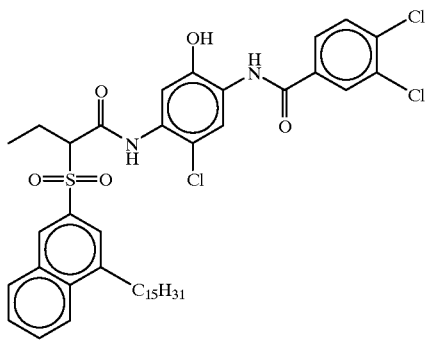

Preferred couplers are IC-3, IC-7, IC-35, and IC-36 because of their suitably narrow left bandwidths.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1 -oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The high boiling solvent of the invention can be described by the general formula (II),

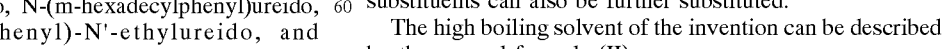

$$R^3OO—C—(—G—)—C—OO—R^4 \quad (II)$$

wherein $R^3$ and $R^4$ represent independently selected alkyl or aryl groups. G represents an alkyl (including cycloalkyl and aralkyl) containing linking group.

$R^3$ and $R^4$ are independently selected alkyl groups such as methyl, ethyl, propyl, butyl, octyl, 2-ethylhexyl, and decyl groups; and aryl groups such as a methylphenyl group.

G represents an alkyl containing linking group, either linear or cyclized, such as methyl, ethyl, propyl, butyl, pentyl, hexyl, heptyl, octyl, nonyl, decyl, undecyl, dodecyl, cyclohexyl, or cyclohexenyl. G may also be substituted along the alkyl chain by one or more groups such as —OH, —OCOR, —COR, —OR, —COOR, —CN, and halogen where R is H or a substituent.

Preferably $R^3$ and $R^4$ are alkyl groups and G is an unsubstituted alkyl group or an alkyl group substituted with a hydroxy and/or one or more carboxylic ester groups.

The term high-boiling means solvents boiling above 100° C., typically above 140° C. The following solvents further illustrate a preferred embodiment of the invention. It is not to be construed that the present invention is limited to these examples.

S-1

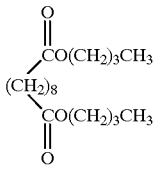

S-2

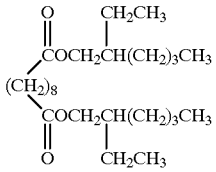

S-3

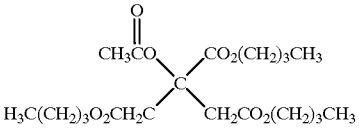

S-4

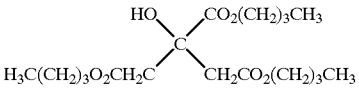

S-5

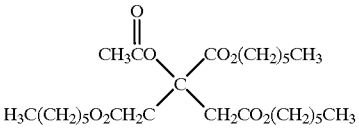

S-6

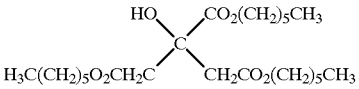

S-7

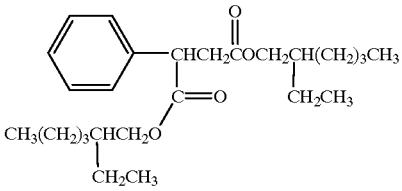

-continued

S-8

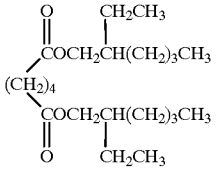

S-9

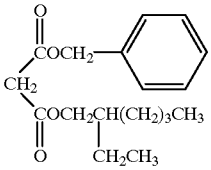

S-10

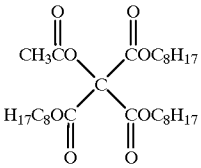

S-11

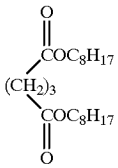

S-12

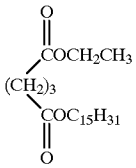

S-13

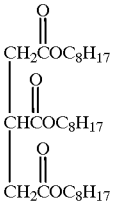

S-14

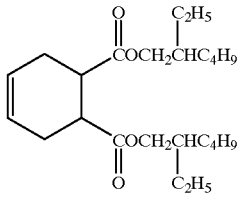

S-15

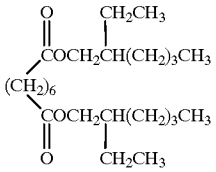

-continued

S-16

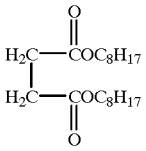

S-17

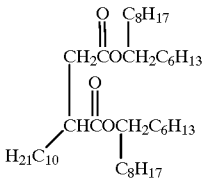

S-18

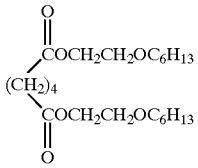

S-19

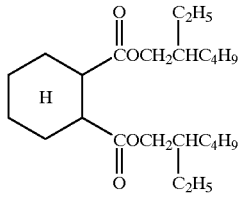

The stabilizers of the invention can be described by the general Formula (III):

(III)

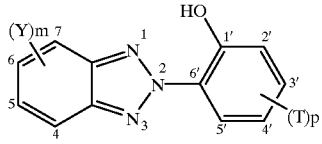

wherein each Y is an independently selected substituent and m is 0 to 4; and each T is an independently selected substituent and p is 0 to 4.

Suitably each Y is independently selected from hydrogen, halogen, nitro, and a substituent selected from the group consisting of unsubstituted or substituted alkyl, aryl, alkoxy, aryloxy, acyloxy, alkyl- or aryl-thio, mono- or di-alkylamino, acylamino, alkoxycarbonyl and a 5-membered or 6-membered heterocyclic group containing a nitrogen, oxygen or sulfur atom, and m is 0 to 4; and each T is independently selected from hydrogen, halogen and a substituent selected from the group consisting of unsubstituted or substituted alkyl, aryl, alkoxy, aryloxy, acyloxy, alkyl- or aryl-thio, mono- or di-alkylamino, acylamino, and a 5-membered or 6-membered heterocyclic group containing a nitrogen, oxygen or sulfur atom, and p is 0 to 4.

More preferably the 5-position of the benzotriazole ring is unsubstituted or substituted with an unsubstituted alkyl group and/or the 6-position is unsubstituted or substituted with a chlorine atom. Furthermore the 3' and 5' positions of the phenyl ring are preferably unsubstituted and the 2'- and/or 4'-positions are preferably substituted with an unsubstituted or substituted alkyl group, especially a branched alkyl group such as a t-butyl, t-pentyl or 2-ethylhexyl group. More preferably the ring is di-substituted at the 2'- and 4'-positions.

The following stabilizers further illustrate the invention. It is not to be construed that the present invention is limited to these examples.

ST-1

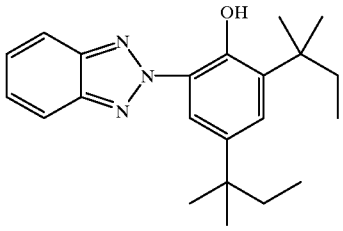

ST-2

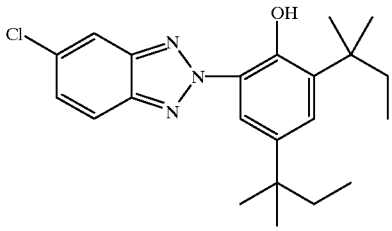

ST-3

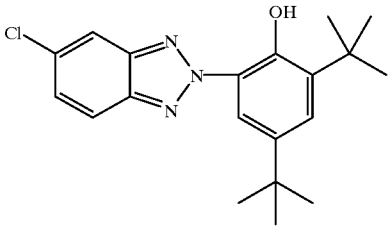

ST-4

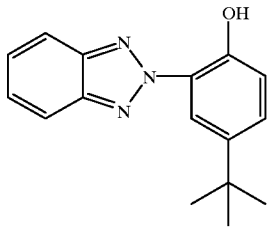

-continued
ST-5
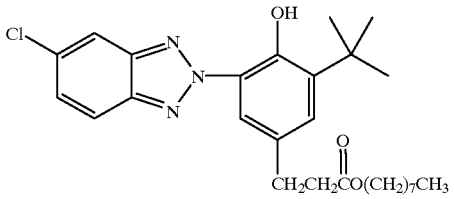
ST-6
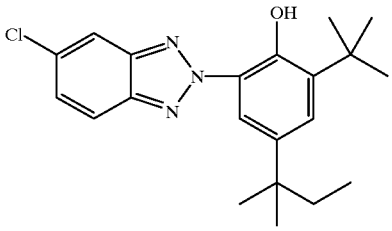
ST-7
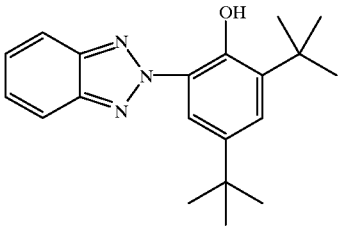
ST-8
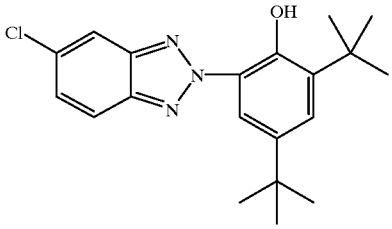
ST-9
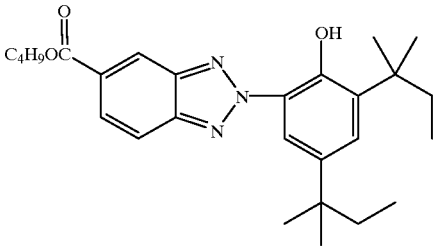
ST-10
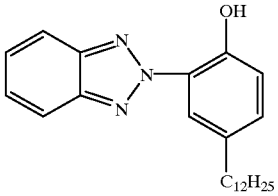
ST-11
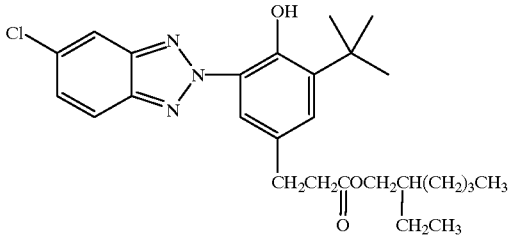
ST-12
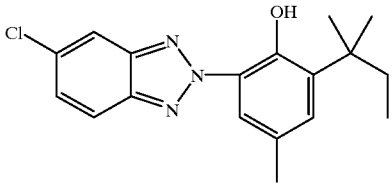
ST-13
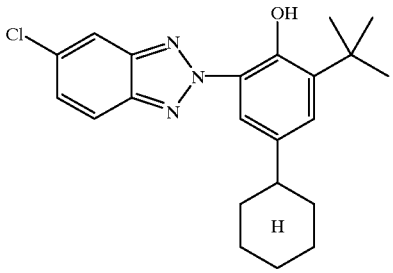
ST-14
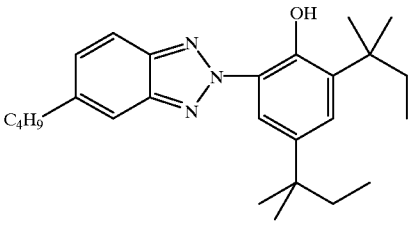
ST-15
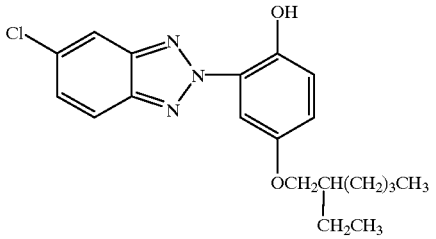
ST-16
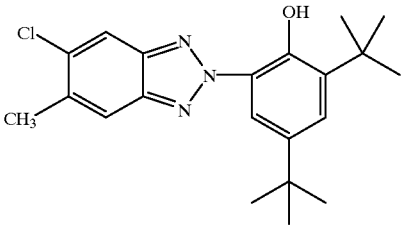

-continued

ST-17

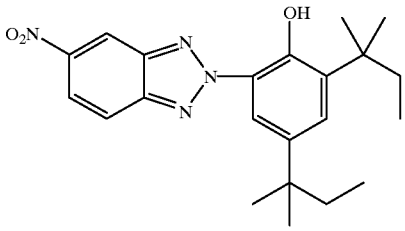

ST-18

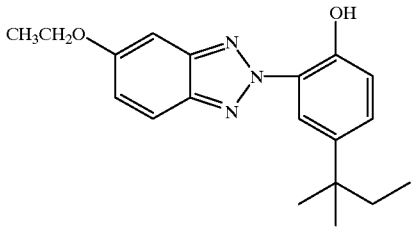

ST-19

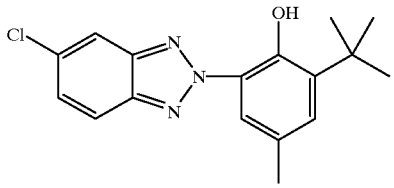

ST-20

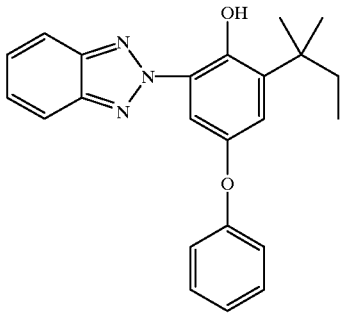

ST-21

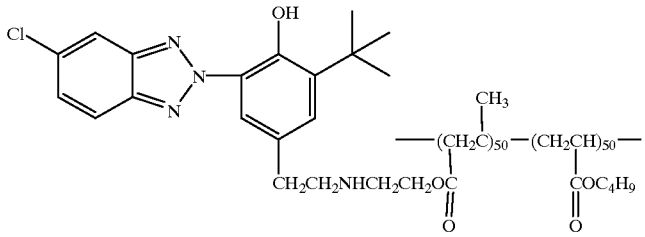

ST-22

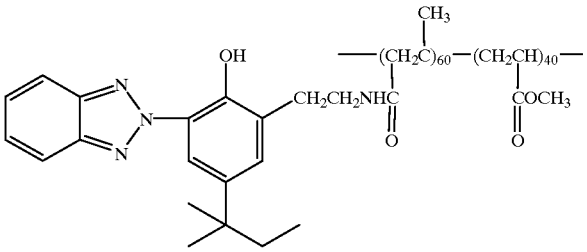

Embodiments of the invention enable the use of lower amounts of coupler and silver by improving the efficiency with which oxidized color developer reacts with the coupler to form dye. Embodiments of the invention exhibit reduction of low unwanted side-band absorption, especially unwanted green absorption and provide dye evidencing improved stability to light, heat, and humidity and improved hue.

The dispersion of the "NB Couplers" and stabilizers for use in the invention can be prepared by dissolving the materials in one or more high-boiling permanent organic solvents, including those solvents represented by formula (II), with or without a low-boiling or partially water-soluble auxiliary organic solvent. The resulting organic solution may then be mixed with an aqueous gelatin solution, and the mixture passed through a mechanical mixing device suitable for high-shear or turbulent mixing generally suitable for preparing photographic emulsified dispersions, such as a colloid mill, homogenizer, microfluidizer, high-speed mixer, ultrasonic dispersing apparatus, blade mixer, device in which a liquid stream is pumped at high pressure through an orifice or interaction chamber, Gaulin mill or blender to form small particles of the organic phase suspended in the aqueous phase. More than one type of device may be used to prepare the dispersions. The auxiliary organic solvent may then removed by evaporation, noodle washing, or membrane dialysis. The dispersion particles preferably have an average particle size of less than 2 $\mu$m, generally from about 0.02 to 2 $\mu$m, more preferably from about 0.02 to 0.5 $\mu$m, especially from about 0.02 to 0.3 $\mu$m. These methods are described in detail in U.S. Pat. Nos. 2,322,027, 2,787,544, 2,801,170, 2,801,171, 2,949,360, and 3,396,027, the disclosures of which are incorporated by reference herein.

Examples of suitable auxiliary solvents which can be used in the present invention include: ethyl acetate, isopropyl acetate, butyl acetate, ethyl propionate, 2-ethoxyethylacetate, 2-(2-butoxyethoxy) ethyl acetate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane and 1,2-dichloropropane.

The aqueous phase of the coupler dispersions for use in the invention preferably comprise gelatin as a hydrophilic colloid. This may be gelatin or a modified gelatin such as acetylated gelatin, phthalated gelatin or oxidized gelatin. Gelatin may be base-processed, such as lime-processed gelatin, or may be acid-processed, such as acid processed ossein gelatin. Other hydrophilic colloids may also be used, such as a water-soluble polymer or copolymer including, but not limited to poly(vinyl alcohol), partially hydrolyzed poly(vinyl acetate-co-vinyl alcohol), hydroxyethyl cellulose, poly(acrylic acid), poly(1-vinylpyrrolidone), poly (sodium styrene sulfonate), poly(2-acrylamido-2-methane sulfonic acid), polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-ionic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate.

In an alternative embodiment, the "NB Coupler" may be dispersed without any high-boiling organic solvent. This could take the form of microprecipitated dispersions of photographic couplers prepared by solvent and/or pH shift techniques (see references: U.K. Patent No. 1,193,349; Research Disclosure 16468, December 1977 pp.75–80; U.S. Pat. Nos. 4,970,139; 5,089,380; 5,008,179; 5,104,776). These no-solvent coupler dispersions could be combined with a separate dispersion containing one or more high boiling solvents, or more specifically, which includes at least one solvent of formula (II) in an aqueous coating solution.

Aqueous dispersions of high-boiling solvents of formulae (II) can be prepared similarly to the coupler dispersion, e.g., by adding the solvent to an aqueous medium and subjecting such mixture to high shear or turbulent mixing as described above. The aqueous medium is preferably a gelatin solution, and surfactants and auxiliary solvents may also be used as described above. Additionally, a hydrophobic additive may be dissolved in the solvent to prevent particle growth as described in U.S. Pat. No. 5,468,604, the disclosure of which is incorporated by reference. The mixture is then passed through a mechanical mixing device such as a colloid mill, homogenizer, microfluidizer, high speed mixer or ultrasonic dispersing apparatus to form small particles of the organic solvent suspended in the aqueous phase. If an auxiliary solvent is employed, it is then subsequently removed by evaporation, noodle washing, or membrane dialysis. These methods are described in detail in the aforementioned references on dispersion making. The solvent dispersion may be a "blank" dispersion which does not contain any additional photographically useful compounds, or the solvent may be part of a photographically useful compound dispersion.

An aqueous coating solution in accordance with the present invention may then be prepared by combining a cyan coupler dispersion with the separate dispersion of the high-boiling organic solvent of formula (II). Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g. 30 to 50° C.) for a short period of time (e.g. 5 min to 4 h) prior to coating.

Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent layer.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

Typical pyrazoloazole and pyrazolone couplers are represented by the following formulas:

MAGENTA-1

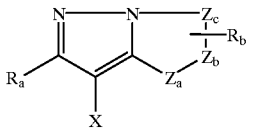

MAGENTA-2

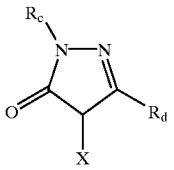

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$.

Specific examples of such couplers are:

M-1

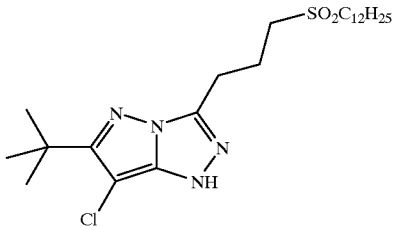

M-2

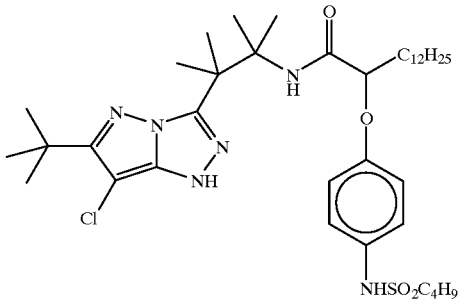

M-3

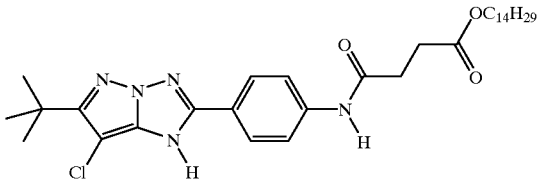

M-4

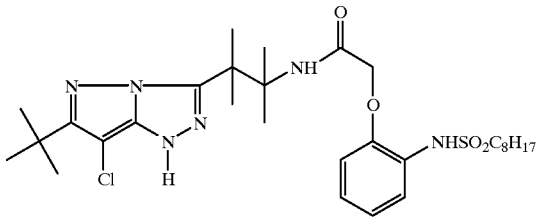

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 3,960,570, 4,022,620, 4,443,536, 4,910,126 and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

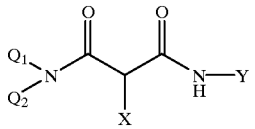

YELLOW-2

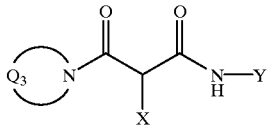

YELLOW-3

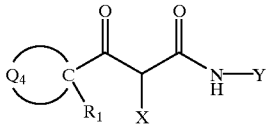

-continued

YELLOW-4

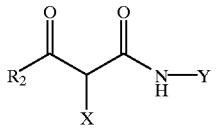

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group.

Preferred yellow couplers can be of the following general structures

Y-1

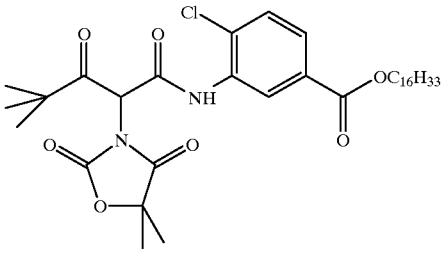

Y-2

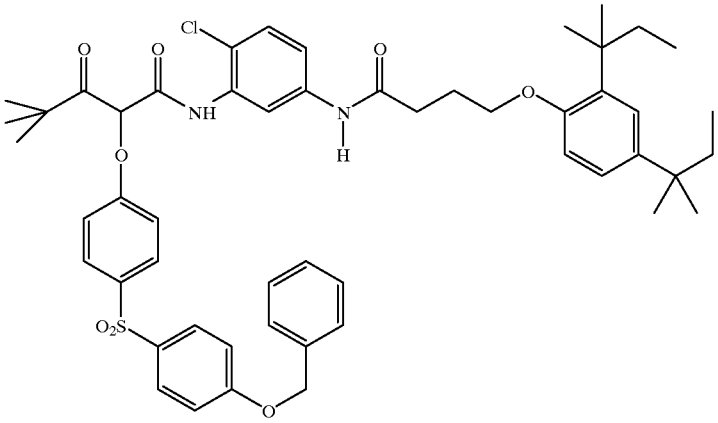

Y-3

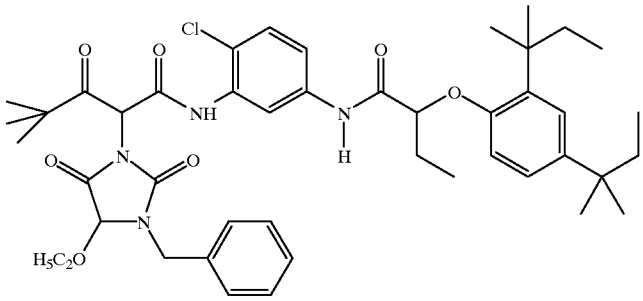

-continued

Y-4

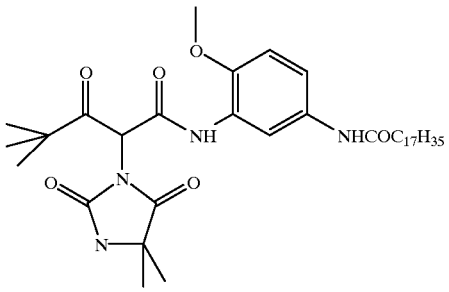

Y-5

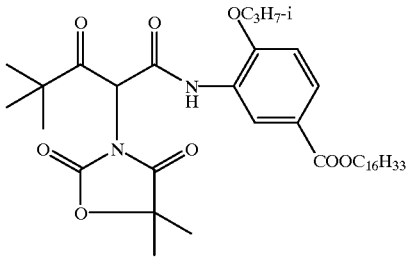

Y-6

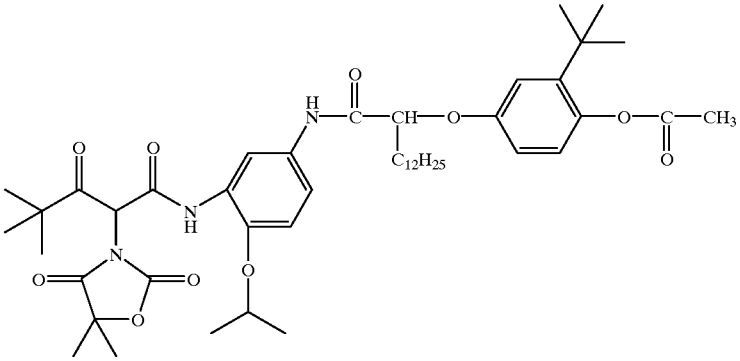

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anticolor-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959. Useful supports include those described in U.S. Pat. No. 5,866,282.

Any silver halide combination can be used for the photographic element, such as silver chloride, silver chlorobromide, silver chlorobromoiodide, silver bromide, silver bromoiodide, or silver chloroiodide. In cases where the emulsion composition is a mixed halide, the minor component may be added in the crystal formation or after formation as part of the sensitization or melting. The shape of the silver halide emulsion grain can be cubic, pseudo-cubic, octahedral, tetradecahedral or tabular. The emulsions may be precipitated in any suitable environment such as a ripening environment, a reducing environment or an oxidizing environment.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The coupler dispersions could be coated with emulsions to form photographic elements at very low levels of silver (less than 100 $mg/m^2$). Reasons for doing this include reducing cost, reducing the thickness of silver halide emulsion layers to gain sharpness advantages and reducing the environmental impact during and after processing.

One class of low silver photographic material is color material intended for redox amplification processes wherein the developed silver acts as a catalyst to the formation of the dye image. This process can take place in a low volume thin processor, such as a low volume thin tank (LVTT), for example, disclosed in U.S. Pat. No. 5,436,118. Redox amplification processes have been described for example in GB 1,268,126, GB 1,399,481, GB 1,403,418, GB 1,560,572, U.S. Pat. No. 3,748,138, U.S. Pat. No. 3,822,129 and U.S. Pat. No. 4,097,278. In such processes, color materials are developed to produce a silver image (which may contain only small amounts of silver) and are then treated with a redox amplifying solution (or a combined developer-amplifier) to form a dye image.

EXAMPLE 1

Determination of "NB Couplers"

Using procedures known to those skilled in synthetic chemistry, such as described in J. Bailey, JCS Perkin 1, 1977, 2047, the dyes of the couplers in Table 1 below were prepared by coupling with 4-amino-3-methyl-N-ethyl-N-(2-methane-sulfonamidoethyl) aniline sesquisulfate hydrate, then purified by either crystallization or chromatographic techniques.

A 3% w/v solution of di-n-butyl sebacate (solvent S-1) was made with ethyl acetate and from this solution a 3% solution of the dye based on solvent S-1 was prepared. If the dye was insoluble, dissolution was achieved by the addition of some methylene chloride. The solution was filtered and 0.1–0.2 ml was applied to a clear polyethylene-terephthalate support (approx. 4 cm×4 cm) and spun at 4000 RPM using the Spin-Coating equipment, Model No. EC101, available from Headway Research Inc., Garland Tex. The normalized (density of 1.00) transmission spectra of the so-prepared dye samples were then recorded. The transmission spectra of the same dye in acetonitrile was also measured and normalized to a density of 1.00.

The $\lambda_{max}$ values, "half bandwidth" (HBW), and "left bandwidth" (LBW) values for each normalized spectra are reported in Table 1 below. The wavelength of maximum absorption was recorded as the λmax. The half bandwidth (HBW) was obtained by subtracting the wavelength at the point on the left side (short wavelength) of the absorption band where the normalized density is 0.50 from the wavelength at the point on the right side (long wavelength) of the absorption band where the normalized density is 0.50. The left bandwidth (LBW) was obtained by subtracting the wavelength at the point on the left side (short wavelength) of the absorption band where the normalized density is 0.50 from the wavelength of maximum absorption.

In solution, each of the four dyes have similar LBW values. Upon spin-coating, the LBW values of the dyes from IC-7 and IC-35 are 32 nm and 28 nm less than the LBW values of the same dyes in solution, respectively. These couplers therefore meet the criterion defined for "NB couplers". The spin-coating LBW values for the dyes from comparison couplers CC-1 and CC-2 are different from the solution LBW values by only 1 nm, and therefore are not "NB couplers".

TABLE 1

Spin Coating (SC), and acetonitrile solution (Soln.) Data (nm)

| Dye | $\lambda_{max}$ (Soln.) | $\lambda_{max}$ (SC) | HBW (Soln.) | HBW (SC) | LBW (Soln.) | LBW (SC) | Difference = LBW (Soln.) – LBW (SC) |
|---|---|---|---|---|---|---|---|
| IC-7 | 637 | 619 | 123 | 73 | 66 | 34 | 32 |
| IC-35 | 633 | 624 | 123 | 77 | 64 | 36 | 28 |
| CC-1 | 628 | 631 | 121 | 126 | 63 | 62 | 1 |
| CC-2 | 626 | 634 | 124 | 126 | 64 | 63 | 1 |

Comparison Couplers.

CC-1

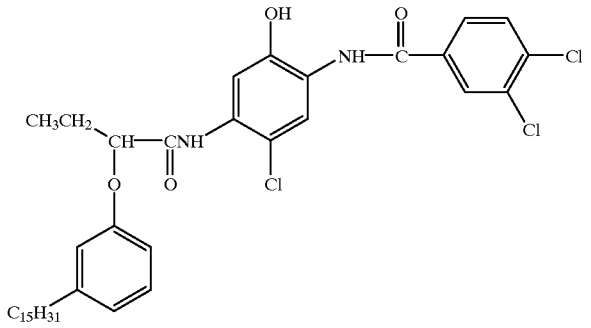

CC-2

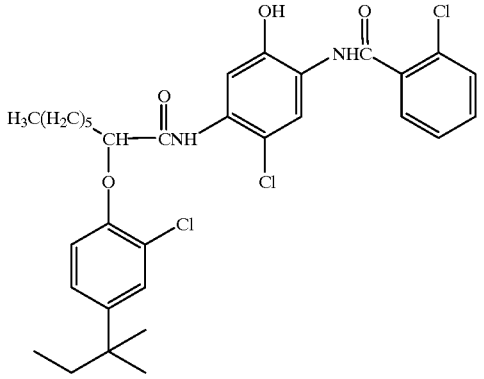

EXAMPLE 2

Dispersion Preparation

Dispersion 1 was prepared by combining a solution of 8.4 g of Coupler IC-7, 2.8 g of ST-1, and 11.3 g of CS1 at 130° C. with an 80° C. solution consisting of 9.0 g decalcified gelatin, 109.5 g de-mineralized water, and 9.0 g of a 10% solution of surfactant Alkanol XC (trademark of E. I. Dupont Co.). This combined solution was mixed for one minute at 8000 rpm using a Brinkmann rotor-stator mixer, then homogenized via 2 passes through a Microfluidics Microfluidizer at 570 kg/cm$^2$, 80° C. to produce Dispersion 1. This dispersion was then placed in cold storage until ready for combination with a light-sensitive photographic emulsion in a photographic element.

Dispersion 2 was prepared as Dispersion 1, except replacing CS-1 with S-1.

Dispersion 3 was prepared as Dispersion 1, except that the first solution contained 9.0 g of Coupler IC-7, 5.4 g of CST-1, and 2.7 g of S-2, and 5.4 g S-3 at 130° C.

Dispersion 4 was prepared as Dispersion 1, except that the first solution contained 8.1 g of Coupler IC-7, 4.6 g of CST-1, and 9.7 g of S-1 at 130° C.

Dispersion 5 was prepared as Dispersion 1, except that a solution of 16.3 g of Coupler IC-7, 9.3 g of ST-1, and 19.5 g of S-1 at 130° C. was combined with an 80° C. solution consisting of 18.0 g decalcified gelatin, 219.0 g de-mineralized water, and 18.0 g of a 10% solution of surfactant Alkanol XC.

Dispersion 6 was prepared as Dispersion 1, except that the first solution contained 5.6 g of Coupler IC-7, 4.2 g of ST-1, and 12.7 g of S-1.

Dispersion 7 was prepared as Dispersion 6, except with 8.4 g of ST-1, and 8.4 g of S-1.

Dispersion 8 was prepared as Dispersion 6, except with 0 g of ST-1, and16.9 g of S-1.

Dispersion 9 was prepared as Dispersion 1, except that the first solution contained 8.1 g of Coupler IC-7, 4.6 g of ST-1, and 9.7 g of S-1.

Dispersion 10 was prepared as Dispersion 1, except replacing solvent S-1 with solvent S-3.

To evaluate the effectiveness of the coupler solvent to provide dispersion with a minimum amount of crystalline material in each dispersion, samples of Dispersions 1–10 were examined via cross-polar microscopy at 98× magnification after storage of the dispersions at 5° C. for 24 hours. Polaroid photographs were taken and the number of crystals observed in the approximately 72 mm×94 mm area of the photograph were counted and are reported in Table 2b.

TABLE 2a

| Dispersion descriptions | | | | | |
|---|---|---|---|---|---|
| Dispersion | Solvent | Stabilizer | Coupler wt fraction | Solvent wt fraction | Stabilizer wt fraction |
| 1 | CS-1 | ST-1 | 0.375 | 0.500 | 0.125 |
| 2 | S-1 | ST-1 | 0.375 | 0.500 | 0.125 |
| 3 | CS-2:CS-3 1:2 | CST-1 | 0.400 | 0.360 | 0.240 |
| 4 | S-1 | CST-1 | 0.361 | 0.432 | 0.206 |
| 5 | S-1 | ST-1 | 0.361 | 0.432 | 0.206 |
| 6 | S-1 | ST-1 | 0.250 | 0.563 | 0.188 |
| 7 | S-1 | ST-1 | 0.250 | 0.375 | 0.375 |
| 8 | S-1 | — | 0.250 | 0.750 | 0.000 |

TABLE 2a-continued

| Dispersion descriptions | | | | | |
|---|---|---|---|---|---|
| Dispersion | Solvent | Stabilizer | Coupler wt fraction | Solvent wt fraction | Stabilizer wt fraction |
| 9 | S-1 | ST-1 | 0.361 | 0.432 | 0.206 |
| 10 | S-3 | ST-1 | 0.361 | 0.432 | 0.206 |

TABLE 2b

| Dispersion results | | |
|---|---|---|
| Dispersion | Number of Crystals | Comment |
| 1 | 225 | Comparison |
| 2 | 125 | Invention |
| 3 | 350 | Comparison |
| 4 | 215 | Comparison |
| 5 | 45 | Invention |
| 6 | 125 | Invention |
| 7 | 90 | Invention |
| 8 | 60 | Comparison |
| 9 | 85 | Invention |
| 10 | 28 | Invention |

Dispersion 1 containing comparison solvent CS-1 has a high number of crystals. The use of the solvent of the invention S-1 in Dispersion 2 reduced the number of crystals.

Dispersion 3 containing comparison solvents CS-2 and CS-3 and comparison stabilizer CST-1 has a high number of crystals. Use of the solvent of the invention with CST-1 reduces the number of crystals, as in Dispersion 4, but further improvement is achieved through the use of the solvent of the invention S-1 combined with stabilizer of the invention ST-1 as in Dispersions 5, 6, 7, and 9. The use of solvent S-3 with ST-1 and IC-7 also provided a dispersion with low crystals, as in Dispersion 10. The combination of the coupler of the invention and the solvent of the invention also provided a low crystal dispersion, as in Dispersion 9.

Comparison Stabilizer CST-1

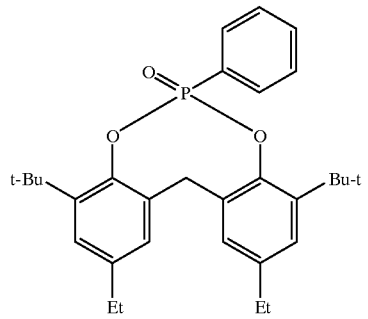

Comparison Solvent CS-1

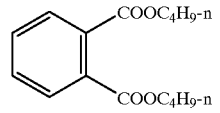

Comparison Solvent CS-2

$CH_3(CH_2)_7CH{=}CH(CH_2)_8OH$

Comparison Solvent CS-3

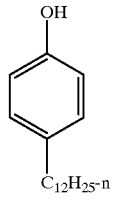

EXAMPLE 3

Preparation of Photographic Elements

Using the dispersions of Example 2, photographic elements 100 through 110 were prepared by coating the following layers on a gel-subbed, polyethylene-coated paper support:

First Layer

An underlayer containing 3.23 grams gelatin per square meter.

Second Layer

A photosensitive layer containing (per square meter) 1.53 grams gelatin, an amount of red-sensitized silver chloride emulsion containing the silver necessary to coat 0.150 grams per square meter of silver, except Element 100 which contained 0.187 grams per square meter of silver, and an amount of dispersion necessary to coat the amount of coupler in grams per square meter as specified in Table 3a.

Third Layer

A layer containing 1.40 grams gelatin per square meter.

Fourth Layer

A protective layer containing (per square meter) 1.08 grams gelatin, 0.127 grams bis(vinylsulfonyl)methane ether, 8.83 milligrams Alkanol XC, and 3.34 milligrams tetraethylammonium perfluorooctanesulfonate.

Element 100 used a commercial dispersion, designated Dispersion 0, containing coupler CC-3, CS-1, and ST-1 in the ratio specified by Table 3a. Elements 109–110 were prepared as elements 100–108, except that the second layer contained 1.66 grams gelatin per square meter.

Comparison Coupler CC-3

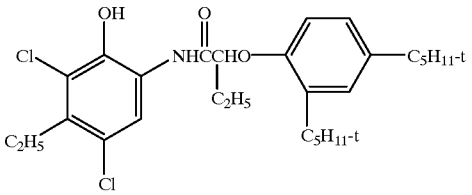

Preparation of Processed Photographic Examples

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| | |
|---|---|
| Developer | |
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| Bleach-Fix | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7° C. | |

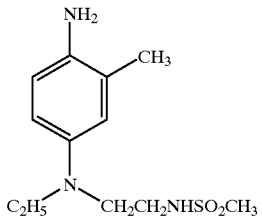

$\cdot 1.5H_2SO_4 \cdot H_2O$

Dev-1

The Status A red densities of the processed strips were read and sensitometric curves (density vs log exposure) were generated. The contrast (γ) was measured by calculating the slope of the density vs log exposure plot over the range of 0.6 log E centered on the exposure yielding 1.0 density. This value is reported in Table 3b.

The spectra of the resulting dyes were measured and normalized to a maximum absorption of 1.00. The wavelength of maximum absorption was recorded as the "λmax." As a measure of the sharpness of the curve on the left (short wavelength) side of the absorption band the "left bandwidth" (LBW) was obtained by subtracting the wavelength at the point on the left side of the absorption band where the normalized density is 0.50 from the λmax. A lower value of LBW indicates a reduction in the unwanted green absorption and is thus desirable. Unwanted green absorption from cyan dye was also measured as the amount of density in the normalized spectra at 530 nm. The λmax, LBW, and 530 nm density values are shown in Table 3b.

TABLE 3a

Description of Photographic Elements for Example 3.

| Element | Dispersion | Coupler | Solvent | Stabilizer | Coupler Laydown (mg/m$^2$) | Solvent Laydown (mg/m$^2$) | Stabilizer Laydown (mg/m$^2$) |
|---|---|---|---|---|---|---|---|
| 100 | 0 | C-1 | CS-1 | ST-1 | 423 | 415 | 272 |
| 101 | 1 | IC-7 | CS-1 | ST-1 | 431 | 574 | 144 |
| 102 | 2 | IC-7 | S-1 | ST-1 | 431 | 574 | 144 |
| 103 | 3 | IC-7 | CS-3:CS-4 1:2 | CST-1 | 484 | 436 | 291 |
| 104 | 4 | IC-7 | S-1 | CST-1 | 415 | 496 | 237 |
| 105 | 5 | IC-7 | S-1 | ST-1 | 415 | 496 | 237 |
| 106 | 6 | IC-7 | S-1 | ST-1 | 287 | 647 | 216 |
| 107 | 7 | IC-7 | S-1 | ST-1 | 287 | 431 | 431 |
| 108 | 8 | IC-7 | S-1 | — | 287 | 861 | 0 |
| 109 | 9 | IC-7 | S-1 | ST-1 | 484 | 580 | 275 |
| 110 | 10 | IC-7 | S-3 | ST-1 | 484 | 580 | 275 |

TABLE 3b

Photographic results.

| Element | γ | λmax | LBW | Density at 530 nm | Comment |
|---|---|---|---|---|---|
| 100 | 2.87 | 656 | 88 | 0.229 | Comparison |
| 101 | 3.00 | 624 | 58 | 0.217 | Comparison |
| 102 | 3.00 | 620 | 52 | 0.190 | Invention |
| 103 | 2.80 | 626 | 54 | 0.168 | Comparison |
| 104 | 2.93 | 624 | 58 | 0.220 | Comparison |
| 105 | 2.99 | 624 | 54 | 0.184 | Invention |
| 106 | 2.88 | 622 | 52 | 0.180 | Invention |
| 107 | 2.89 | 620 | 46 | 0.166 | Invention |
| 108 | 2.89 | 622 | 54 | 0.191 | Comparison |
| 109 | 2.95 | 624 | 54 | 0.182 | Invention |
| 110 | 2.90 | 626 | 56 | 0.183 | Invention |

Element 100 with comparison coupler C-1 in combination with comparison solvent CS-1 and stabilizer ST-1 has a high LBW and high density at 530 nm. Element 101 with the coupler of the invention with the same solvent and stabilizer has an improved lower LBW, but is hardly lower in density at 530 nm. Changing the solvent to the solvent of the invention as in Element 102 improved the LBW and density at 530 nm. Element 103 with comparison solvents CS-3 and CS-4 has low LBW and very low density at 530 nm, but the γ is reduced. Element 104 with a solvent of the invention resulted in higher LBW and density at 500 nm. Element 105 with the solvent and stabilizer of the invention are improved in LBW and density at 530 nm.

Element 106 contains the stabilizer and solvent of the invention which gives a low density at 530 nm, and maintains good gamma at lower coupler laydown. Further reduction of the density at 530 nm is achieved through higher laydown of the stabilizer of the invention in Element 107. Complete removal of the ST-1, as in Element 108 does not take full advantage of the hue improvement associated with the combination of the invention.

Examination of Tables 2b and 3b demonstrate that the use of the solvents and stabilizers of the invention with the coupler of the invention overcome the disadvantages of solvents previously used which do not allow for good dissolution of the coupler, maintenance of good reactivity, or minimization of the amount of unwanted green absorption of the dye formed from the coupler of the invention.

The entire contents of the various patents and other publications referred to in this specification are incorporated herein by reference.

What is claimed is:

1. A photographic element comprising at least one light sensitive silver halide emulsion layer having associated therewith:

(A) a phenolic cyan dye-forming "NB coupler";

(B) a high boiling solvent having Formula (II):

$$R^3OO—C—(—G—)—C—OO—R^4 \quad (II)$$

wherein:

$R^3$ and $R^4$ represent independently selected alkyl or aryl groups; and

G represents an alkyl containing linking group.

2. A photographic element comprising at least one light sensitive silver halide emulsion layer having associated therewith:

(A) a cyan dye-forming coupler of formula (I)

(I)

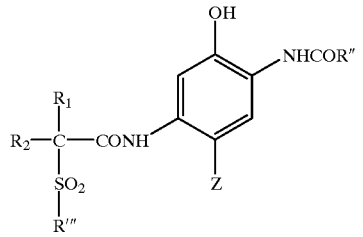

wherein:

$R_1$ and $R_2$ are independently hydrogen or an alkyl group; and

R" and R'" are independently an alkyl or aryl group or a 5–10 membered heterocyclic ring which contains one or more heteroatoms selected from nitrogen, oxygen, and sulfur, and (B) a high boiling solvent having Formula (II):

$$R^3OO—C—(—G—)—C—OO—R^4 \quad (II)$$

wherein:

$R^3$ and $R^4$ represent independently selected alkyl or aryl groups; and

G represents an alkyl containing linking group.

3. A photographic element comprising at least one light sensitive silver halide emulsion layer having associated therewith:

(A) a phenolic cyan dye-forming "NB coupler";

(B) a high boiling solvent having Formula (II):

$$R^3OO—C—(—G—)—C—OO—R^4 \quad (II)$$

wherein:

$R^3$ and $R^4$ represent independently selected alkyl or aryl groups; and

G represents an alkyl (including cycloalkyl and aralkyl) containing linking group; and (C) a stabilizer having Formula (III):

(III)

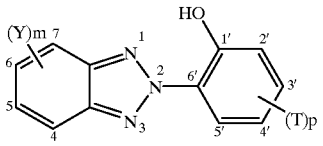

wherein each Y is an independently selected substituent and m is 0 to 4; and each T is an independently selected substituent and p is 0 to 4.

4. The element of claim 3 wherein the left bandwidth (LBW) of the absorption spectra upon "spin coating" in di-n-butyl sebacate the dye formed from coupling the "NB coupler" with the developer 4-amino-3-methyl-N-ethyl-N-(2-methanesulfonamidoethyl) aniline sesquisulfate hydrate is at least 15 nm less than the LBW for a 3% w/v solution of the same dye in acetonitrile.

5. The element of claim 3 wherein the left bandwidth (LBW) of the absorption spectra upon "spin coating" in di-n-butyl sebacate the dye formed from coupling the "NB coupler" with the developer 4-amino-3-methyl-N-ethyl-N-(2-methanesulfonamidoethyl) aniline sesquisulfate hydrate is at least 25 nm less than the LBW for a 3% w/v solution of the same dye in acetonitrile.

6. The element of claim 3 wherein the "NB coupler" has formula (I-A):

(I-A)

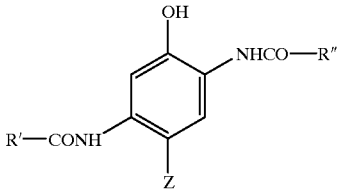

wherein:

R' and R" represent independently selected substituents; and

Z represents a hydrogen atom or a group which can be split off by the reaction of the coupler with an oxidized color developing agent.

7. The element of claim 6 wherein R" is an aryl group.

8. The element of claim 6 wherein R' is a substituted alkyl group.

9. The element of claim 8 wherein R' is a methyl group containing a C1–C4 alkyl substituent group and an aryl sulfonyl substituent group.

10. The element of claim 6 wherein the "NB coupler" has formula (I)

(I)

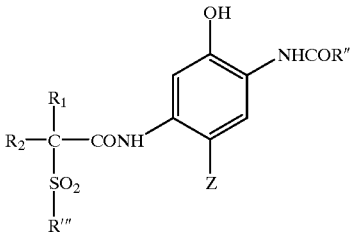

wherein:

$R_1$ and $R_2$ are independently hydrogen or an alkyl group; and

R" and R'" are independently an alkyl, alkoxy, aryl or heterocyclic group.

11. The element of claim 10 wherein R" and R'" each represent an independently selected phenyl group.

12. The element of claim 11 where R'" is an unsubstituted phenyl group.

13. The element of claim 11 where R'" is a substituted phenyl group.

14. The element of claim 3 wherein $R^3$ and $R^4$ represent independently selected alkyl groups with 1 to 18 carbon atoms and G represents an alkyl group that may be substituted with one or more groups selected from —OH, —OCOR, —COR, —COOR, —CN, and halogen where R is a substituent.

15. The element of claim 3 wherein $R^3$ and $R^4$ represent independently selected alkyl groups with 1 to 18 carbon atoms and G represents an alkyl group that may be substituted with one or more groups selected from —OH, —OCOR, and —COR where R is a substituent.

16. The element of claim 3 wherein the 5- and 6-positions of the benzotriazole ring are unsubstituted or substituted with an unsubstituted alkyl group.

17. The element of claim 3 wherein the 5- and 6-positions of the benzotriazole ring are unsubstituted or substituted with a chlorine atom.

18. The element of claim 3 wherein the 3' and 5' positions of the phenyl ring are unsubstituted and one or more of the 2'- and 4'-positions are substituted with an alkyl group.

19. The element of claim 18 wherein the phenyl ring is di-substituted at the 2'- and 4'-positions with an alkyl group.

20. The element of claim 4 wherein $R^3$ and $R^4$ in formula (II) represent independently selected alkyl groups with 1 to 18 carbon atoms and G represents an alkyl group that may be substituted with one or more groups selected from —OH, —OCOR, —COR, —COOR, —CN, and halogen groups where R is a substituent and the 5-position of the benzotriazole ring of formula (III) is unsubstituted or substituted with an unsubstituted alkyl group.

21. The element of claim 4 wherein the 6-position of the benzotriazole ring is unsubstituted or substituted with a chlorine atom.

22. The element of claim 5 wherein $R^3$ and $R^4$ in formula (II) represent independently selected alkyl groups with 1 to 18 carbon atoms and G represents an alkyl group that may be substituted with one or more groups selected from —OH, —OCOR, —COR where R is a substituent, and the 3' and 5' positions of the phenyl ring in formula (III) are unsubstituted and the 2'- and/or 4'-positions are substituted with an alkyl group.

23. The element of claim 10 wherein $R^3$ and $R^4$ in formula (II) represent independently selected alkyl groups with 1 to 18 carbon atoms and G represents an alkyl group that may be substituted with one or more groups selected from —OH, —OCOR, —COR, —COOR, —CN, and halogen where R is a substituent and the 5-position of the benzotriazole ring of formula (III) is unsubstituted or substituted with an unsubstituted alkyl group and the 6-position is unsubstituted or substituted with a chlorine atom.

24. The element of claim 3 wherein said coupler is present in an amount of between 100 and 1000 mg/$m^2$.

25. The element of claim 3 wherein said coupler is present in an amount of between 150 and 800 mg/$m^2$.

26. The element of claim 3 wherein said coupler is present in an amount of between 150 and 650 mg/$m^2$.

27. The element of claim 3 wherein said solvent is present in an amount of between 100 and 1200 mg/$m^2$.

28. The element of claim 3 wherein said solvent is present in an amount of between 200 and 1000 mg/$m^2$.

29. The element of claim 3 wherein said solvent is present in an amount of between 200 and 800 mg/$m^2$.

30. The element of claim 3 wherein said stabilizer is present in an amount of between 50 and 1000 mg/$m^2$.

31. The element of claim 3 wherein said stabilizer is present in an amount of between 100 and 750 mg/$m^2$.

32. The element of claim 3 wherein the element comprises a green sensitized layer that comprises a pyrazoloazole magenta dye forming coupler and a blue sensitized layer that comprises an acylacetamide yellow dye forming coupler.

33. The element of claim 3 in which the w/w ratio of the solvent to the coupler is from about 0.5 to 9.

34. The element of claim 33 in which the w/w ratio of the solvent to the coupler is from about 0.5 to 7.

35. The element of claim 34 in which the w/w ratio of the solvent to the coupler is from about 1 to 5.

36. The element of claim 3 in which the w/w ratio of the stabilizer to the coupler is from about 0.1 to 5.

37. The element of claim 36 in which the w/w ratio of the stabilizer to the coupler is from about 0.2 to 4.

38. The element of claim 37 wherein the w/w ratio of the stabilizer to the coupler is from about 0.25 to 3.

39. The element of claim 11 wherein R" is a substituted phenyl group.

40. The element of claim 39 wherein the substituent on the phenyl ring is an electron-withdrawing group having a positive Hammett's sigma value.

41. The element of claim 10 wherein at least one of $R_1$ and $R_2$ is hydrogen.

42. The element of claim 10 wherein $R_1$ and $R_2$ are selected from hydrogen and substituents groups having up to 4 carbon atoms.

43. The element of claim 10 wherein R'" is a phenyl ring substituted with an alkyl or alkoxy group.

44. The element of claim 43 wherein the group substituted on the phenyl ring contains at least 8 carbon atoms.

45. The element of claim 3 which provides a positive image for viewing.

46. The element of claim 3 that provides the image on a reflective support.

47. The element of claim 45 that provides the image on a transparent support for projection viewing.

48. A process for forming an image in the element of claim 3 comprising contacting the element with a color developing agent after the element has been imagewise exposed.

49. A photographic element comprising at least one light sensitive silver halide emulsion layer having associated therewith:

(A) a cyan dye-forming coupler of formula (I)

(I)

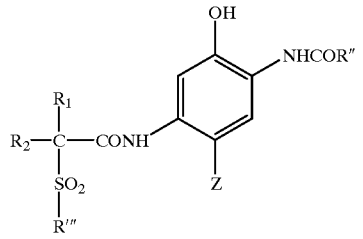

wherein:

$R_1$ and $R_2$ are independently hydrogen or an alkyl group; and

R" and R'" are independently an alkyl or aryl group or a 5–10 membered heterocyclic ring which contains one or more heteroatoms selected from nitrogen, oxygen, and sulfur;

(B) a high boiling solvent having Formula (II):

$$R^3OO—C—(—G—)—C—OO—R^4 \quad (II)$$

wherein:

$R^3$ and $R^4$ represent independently selected alkyl or aryl groups; and

G represents an alkyl (including cycloalkyl and aralkyl) containing linking group; and (C) a stabilizer having Formula (III):

(III)

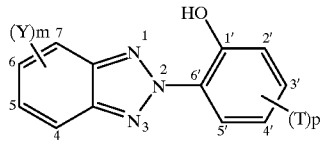

wherein each Y is an independently selected substituent and m is 0 to 4;

each T is an independently selected substituent and p is 0 to 4.

* * * * *